US009058700B2

(12) United States Patent
Chatté

(10) Patent No.: US 9,058,700 B2
(45) Date of Patent: Jun. 16, 2015

(54) FRANKING SYSTEM WITH A VERIFIED DISTRIBUTION POINT

(75) Inventor: Fabien Chatté, Nogent sur Marne (FR)

(73) Assignee: NEOPOST TECHNOLOGIES, Bagneux (FR)

( * ) Notice: Subject to any disclaimer, the term of this patent is extended or adjusted under 35 U.S.C. 154(b) by 1552 days.

(21) Appl. No.: 12/250,944

(22) Filed: Oct. 14, 2008

(65) Prior Publication Data

US 2009/0106039 A1 Apr. 23, 2009

(30) Foreign Application Priority Data

Oct. 12, 2007 (FR) ..... 07 58256

(51) Int. Cl.
*G07B 17/00* (2006.01)

(52) U.S. Cl.
CPC .. *G07B 17/00193* (2013.01); *G07B 2017/0004* (2013.01); *G07B 2017/0012* (2013.01); *G07B 2017/00209* (2013.01); *G07B 2017/00217* (2013.01); *G07B 2017/00443* (2013.01)

(58) Field of Classification Search
CPC ..... B07C 3/00; B07C 3/18; B07C 5/00; G06Q 10/083
USPC ..... 705/1, 1.1, 401–410
See application file for complete search history.

(56) References Cited

U.S. PATENT DOCUMENTS

| | | | | |
|---|---|---|---|---|
| 6,915,281 | B2 * | 7/2005 | Coffy et al. | 705/410 |
| 2006/0004677 | A1 * | 1/2006 | Mattern | 705/403 |
| 2007/0050200 | A1 * | 3/2007 | Kampert | 705/1 |
| 2009/0005901 | A1 * | 1/2009 | Stemmle et al. | 700/215 |

FOREIGN PATENT DOCUMENTS

| | | | |
|---|---|---|---|
| DE | 10133887 | A1 | 1/2003 |
| EP | 0 871 146 | A2 | 10/1998 |
| EP | 1 366 696 | A2 | 12/2003 |
| EP | 1 739 629 | A1 | 1/2007 |
| FR | 2 874 112 | A1 | 2/2006 |

OTHER PUBLICATIONS

Brass, Richard. "Royal Mail Cracks the Code for Success Every Postbox has been Fitted with a Barcode to Ensure the Postal System can Improve its Service to Customers as it Seeks to Cope with Increasing Competition, Reports Richard Brass." The Daily Telegraph Jul. 6, 2006: 003. ProQuest. Feb. 24, 2015.*

* cited by examiner

*Primary Examiner* — Michael Harrington
(74) *Attorney, Agent, or Firm* — Sughrue Mion, PLLC

(57) ABSTRACT

A method of franking a mailpiece that is to be put into a letter box associated with a mail-receiving office, including, in a portable communications device of a sender of the mailpiece, firstly an operation of inputting an identifier of said letter box, and secondly an operation of transmitting the identifier together with other postal data, including at least one franking amount and an unique identification code relating to the mailpiece, to a server of a franking service having the function of issuing a franking authorization for the sender.

11 Claims, 2 Drawing Sheets

FRANKING SYSTEM WITH A VERIFIED DISTRIBUTION POINT

TECHNICAL FIELD

The present invention relates exclusively to the field of processing mail, and it relates more particularly to a franking method implemented via a telecommunications network and in which verification is made easier.

STATE OF THE ART

At present, when an individual or a very small entity (VSE) not possessing a postage meter seeks to pay for the postage of mail (i.e. to frank the mail), it is necessary, possibly after weighing, to stick a stamp on each envelope or package that is to be sent prior to placing it in a letter box. Unfortunately, if the person carrying out this operation does not have any stamps available, then it is necessary to visit the nearest mail-receiving office of the postal authority in order to purchase stamps or have a franking mark placed on the envelope or package. Unfortunately, this can be done only if the office is then open to the public.

That is why the Applicant has made proposals in patent applications FR 2 890 769 and FR 2 896 606 for a franking method that does not require access to a mail-receiving office of the postal authority, but that can be implemented directly via a telecommunications network. The method makes use of a unique identification number preprinted on the mailpiece for sending or placed by the sender on said mailpiece, which identification number is recorded in a database together with data constituting proof of payment of the franking.

That method gives full satisfaction since, at present, it is not very widespread, and therefore involves only a small number of users. The Applicant is seeking to enlarge that service to convert it into a mass market, but there is a particular problem involved in generalizing it to a much larger number of users. In order to verify the validity of the franking, it is necessary for all of the mail-receiving offices of the postal authority to have access in real time (or at least within some predetermined maximum response delay) to the database containing the postal data of all of the users, which database is a single centralized database. Unfortunately, with present-day communications networks, and in particular with the Internet, such access cannot be guaranteed.

DISCLOSURE OF THE INVENTION

An object of the present invention is to thus to provide an improved method of franking via a telecommunications network that mitigates the drawback of the prior art franking method and that enables it to be extended from the small market to which it is presently confined to a mass market.

This object is achieved by a method of franking a mailpiece that is to be put into a letter box associated with a mail-receiving office, wherein it includes, in a portable communications device of a sender of the mailpiece, firstly an operation of inputting an identifier of said letter box, and secondly an operation of transmitting the identifier together with other postal data, including at least one franking amount and an unique identification code relating to the mailpiece, to a server of a franking service having the function of issuing a franking authorization for the sender.

Thus, by accurately identifying the letter box in which the mailpiece is to be posted, it becomes possible to guarantee an access time to the postal data that is compatible with verifying the validity of mailpieces in real time, since only the data corresponding to the mail-receiving office in question is processed.

Advantageously, said unique identification code is applied on the mailpiece or generated in the portable communications device.

In the intended implementation, the operation of inputting said identifier of the letter box may include either manually inputting said identifier via the keypad of said portable communications device, or else optically reading the identifier by digital pickup means of said portable communications device.

In a particular embodiment, said operation of inputting the identifier further includes extracting an electronic address of said mail-receiving office to which said letter box is attached. Under such circumstances, the method preferably includes, from said portable communications device, an operation of transferring to said electronic address a fraction of the postal data corresponding to the mailpiece placed in said letter box.

In another implementation, the method of the invention may further include an operation of said server of the franking service transferring a fraction of the postal data corresponding to the mailpieces placed in said letter box to a server of said mail-receiving office to which said letter box is attached.

Advantageously, said transfer operation is performed at a predetermined periodicity corresponding substantially to the times mail is collected from said letter box.

The invention also relates to a portable communications device for implementing the above-described franking method and advantageously constituted by one of the following devices: a cell phone; a communicating personal digital assistant; a communicating laptop computer.

The invention also provides a computer program including code instructions for implementing steps of the above-described franking method when executed on the portable communications device.

BRIEF DESCRIPTION OF THE DRAWINGS

Other characteristics and advantages of the present invention appear better from the following description made by way of non-limiting indication and with reference to the accompanying drawings, in which.

IMPLEMENTATION(S) OF THE INVENTION

To solve the problem posed this real time access, the invention proposes monitoring the points at which mailpieces are injected into the distribution network of the postal authority. Thus, by associating each mailpiece comprising an unique identification code with an identifier of the letter box into which the mailpiece is to be placed, it becomes possible at any mail-receiving office of the postal authority to access from the database only the postal data that corresponds to mailpieces for which that office needs to verify validity.

Figure 1:
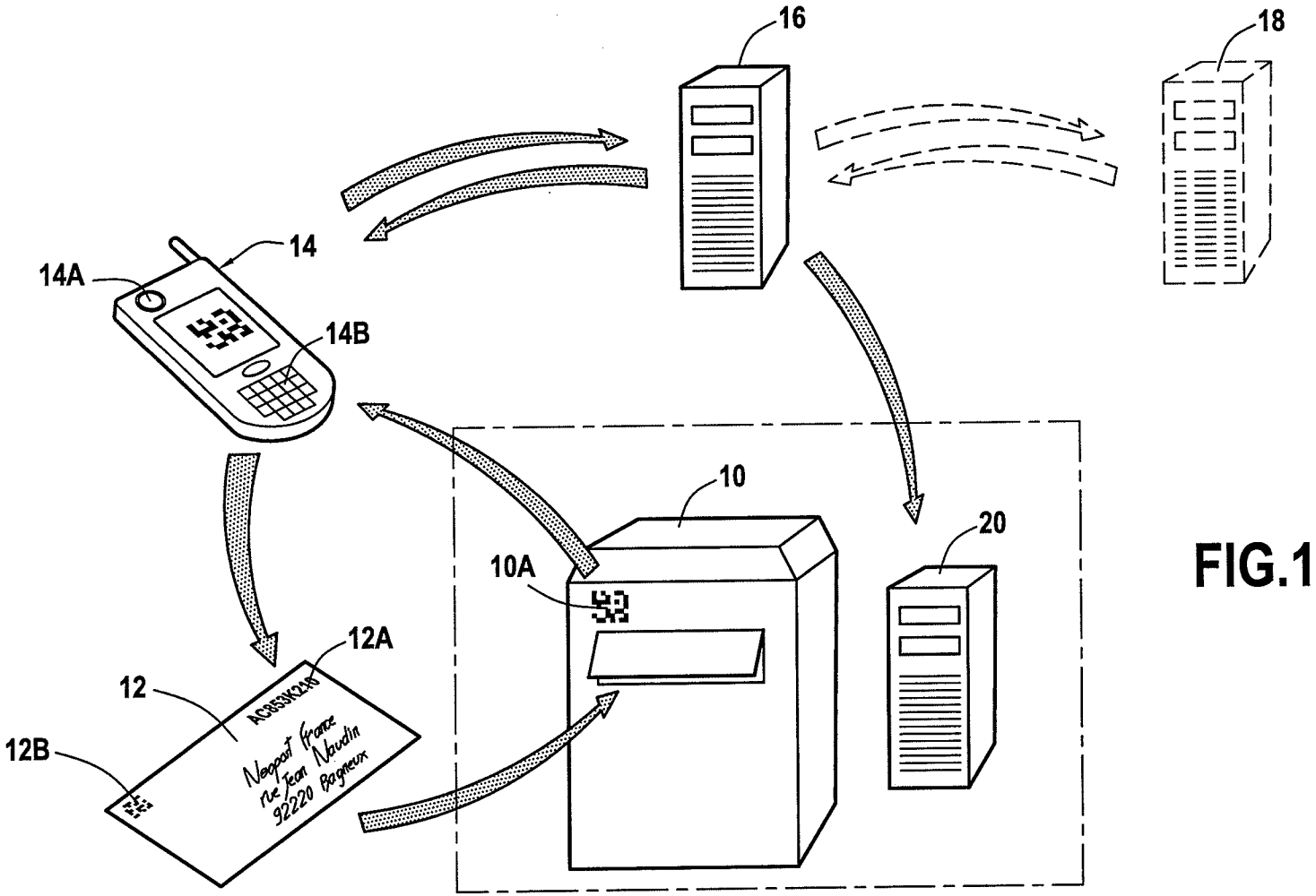
FIG. 1 shows an example of a network architecture that enables the franking method of the invention to be implemented.

FIG. 1 shows an example of a network architecture necessary for implementing the franking method of the invention.

In the invention, the letter box 10 into which a mailpiece (package or envelope 12) is placed by the sender includes an identifier 10A that is advantageously constituted in the form of a code with high capacity for encoding digital or alphanumeric data and for correcting errors, such as a two-dimensional bar code, of which the best known are: Aztec code; Codablock; Code one; Code 16K; Code 49; datamatrix; PDF 417; QD Code, or indeed Supercode. The high encoding capacity of codes of that type (having up to 4296 characters in the highest performance version) thus enables it to include not only a specific number identifying the letter box, but also, in the intended implementation, a short number of the SMS type or an email address of an office for receiving mail with which the letter box is associated.

The identifier is preferably placed on the front face of the letter box so as to make it easier to read by a portable communications device 14 of the sender, which device is used for paying for the franking of the mailpiece placed in this specifically-identified letter box of the mail-receiving office of the postal authority.

The portable communications device 14 may be constituted by any data processor device capable of long-distance wireless communication via a terrestrial or satellite wireless telecommunications network (such as the GMS, UMTS, XiMAX, etc. networks), such as a cell phone, a communicating personal digital assistant (PDA), or indeed a communicating laptop computer. The device advantageously includes digital pickup means 14A, such as an incorporated digital camera (but a connected device such as a light pen could also be envisaged).

During the process of paying for franking, the sender's portable communications device is put into communication with a server system of a franking service 16 located on a site of a provider of this franking service, the server itself possibly being in communication with a server system of a telephone operator 18 who provides, where necessary, payment for the requested franking by debiting the telephone account of the sender, assuming that payment has not been performed beforehand by the server system 16 with which the sender having the portable communications device has previously opened an account. Finally, each of the mail-receiving offices of the postal authority also includes a server system 20 in communication with the server of the franking service 16.

The three server systems 16, 18, 20 may be of similar structure, each having one or more computer central units containing one or more databases that are controlled and managed in conventional manner by one or more computer terminals (not shown). The server system 18 of the telephone operator includes in particular a client database including account data relating to the client of the operator, and the service system 20 available in each of the offices of the postal authority includes in particular a database of the mailpieces placed in the letter boxes associated with each of said offices, constituting an extract of the database that exists in the server system 16 and that includes all of the mailpieces sent using the franking service.

Figure 2:
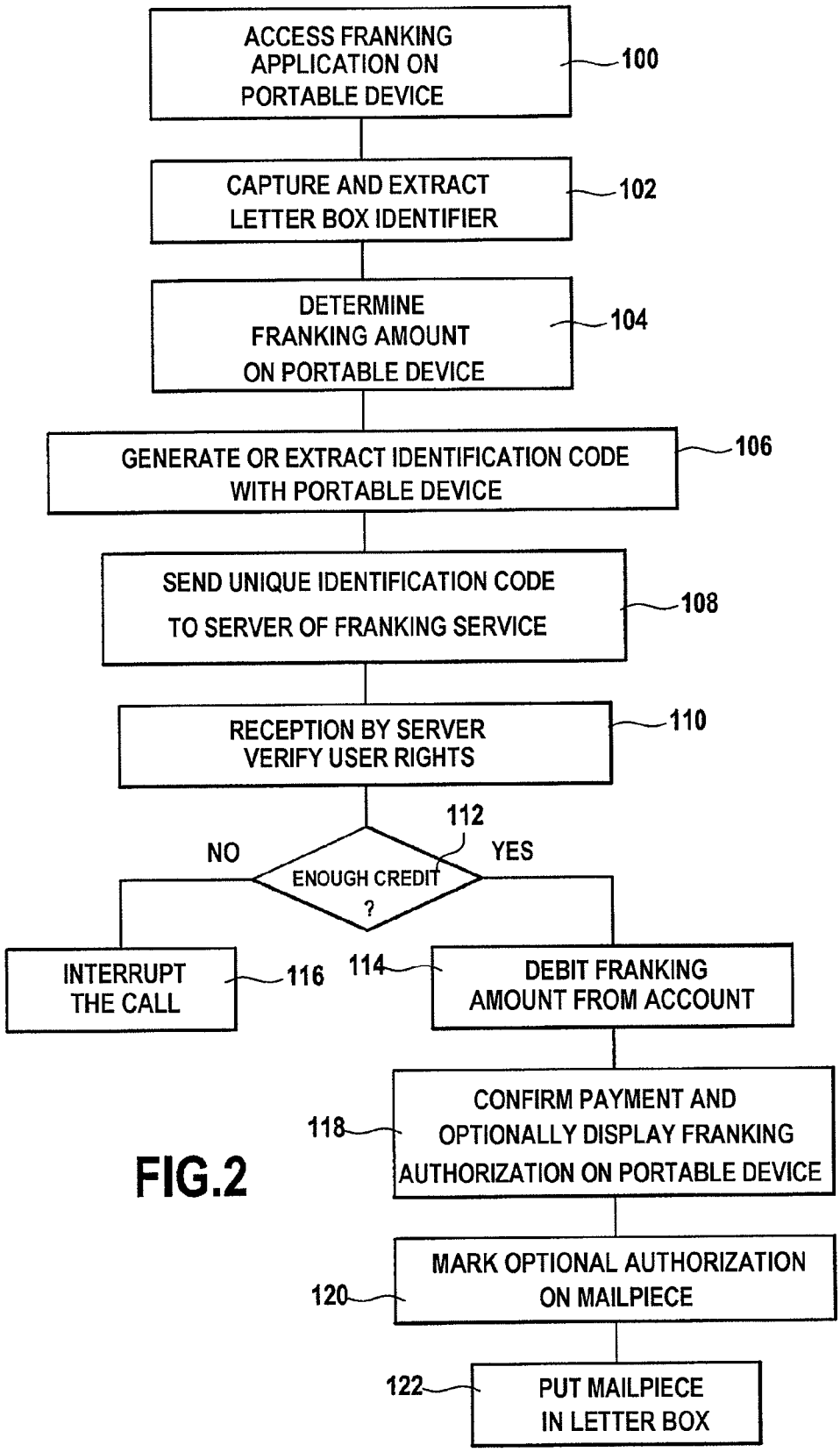
FIG. 2 is a flow chart explaining the various steps in the method implemented on the FIG. 1 network.

FIG. 2 is a flow chart showing the various steps in the method that enable the portable communications device 14 to be used to pay for the franking of a mailpiece 12 placed by a sender in a determined letter box 10, and enables that payment to be verified.

In a first step 100 in this implementation of the method, a sender seeking to send a mailpiece 12 clicks on an icon corresponding to a franking application that is preinstalled on the portable communications device 14. After a personal ID code has been input, the optical reader function of the device is automatically activated and enables the sender to use the digital camera means 10A integrated in the portable communications device to act during a step 102 to input an image of the identifier that appears on the letter box into which the sender is going to place the mailpiece.

As is known, this inputting can be performed by pressing on a picture-taking button (not shown) of the portable communications device, leading to the identifier being recognized automatically and to the data, including the identity number, being extracted. When the portable communications device does not have a digital camera means, the sender is invited to input this identifier manually (which is possible only if the identifier is made up of alphanumeric characters), or to make a selection from a set of identifiers applicable to a determined geographical zone as previously defined by the user, e.g. by means of a scrolling menu. Manual input may be performed, for example, directly using the identifier marked on the letter box, or from a list (optionally including bar codes) that the sender has obtained previously from the local mail-receiving office and listing all of the identifiers associated with that particular mail-receiving office.

The portable communications device then acts, in a following step 104, via its display screen to request the sender to input various items of postal data associated with the mailpiece for sending so as to determine automatically the amount to be franked for this mailpiece. This franking amount is a function of the requested service(s) (e.g. priority or economy rate), the geographical zone of the destination (national or foreign), and the weight category of the mailpiece being sent. Alternatively, the sender might merely be requested to determine under his or her own responsibility the amount required for franking (which can be done if the sender has current postal rates available). By way of example, to send a letter weighing less than 20 grams on a priority basis to the United States, the sender should pay 0.90 euros, whereas for sending an 8 kilogram package at the economic rate to an overseas department, the sender would need to pay 14 euros.

In a following step 106, depending on the type of mailpiece used by the sender, the portable communications device then either generates a unique identification code on the basis of a concatenated combination of the information previously input by the sender such as the destination geographical zone, in particular the destination post code, and the franking amount, with other information available thereto, such as (without this list being limiting): the date, the time, the version of the application software, the identifier of the SIM card, etc., or else it preferably extracts this unique identification code from an identifier 12B carried by the mailpiece, e.g. in the form of a two-dimensional bar code preprinted on the mailpiece.

The portable communications device then acts in a step 108 to send a request to the franking server 16, preferably in the form of an SMS type short message containing the generated or extracted unique identification code, as described above.

In a new step 110, the server 16 recovers this request, and on the basis of the telephone number of the portable communications device (conventionally obtained from the IMSE or IMEI number base of the portable communications device as transmitted during the call) and proceeds with various verifications as to whether or not the holder (sender) is or is not a client of the franking service. If the sender is a client of the service (and therefore has an account with the service), then the server 16 verifies the sender's user rights and whether there is enough money in the account (response "yes" to the test of step 112), then in a step 114 debits the client account the amount that corresponds to the requested franking. If there is not enough in the account, the server invites the sender to increase the credit in the account and the call is then interrupted (step 116). The sender then cannot post the mailpiece other than by allowing the addressee to pay the franking amount plus a fine when the mailpiece is delivered, as for traditional mail.

In contrast, if the sender is not a client of the franking service and therefore does not posses a client account in the server 16, and insofar as there exists an agreement between the provider of the franking service and the telephone operator, the server can relay the franking amount to be paid and the telephone number of the portable communications device associated therewith to the server of the telephone operator 20 who in turn verifies from its own client database whether the sender's account possesses specified telephone credit to pay for the franking amount requested. If the telephone operator finds that the sender's credit is not sufficient, the franking service is informed and then invites the sender, as before, to increase the credit in the account, and the call is then interrupted (step 116). However, if there is sufficient credit, then the telephone account is debited by the corresponding amount and the service 16 of the franking service is credited accordingly such that, in step 118, the server 16 can respond to receiving the unique identification code, by generating a request that it sends to the portable communications device, preferably in the form of an SMS type message, containing confirmation of payment for the franking by the sender, and when the mailpiece does not already have its own preprinted identification code, causing a franking authorization code to be displayed on the display screen of the portable communications device.

In a step 122, the sender then need only place the mailpiece in the letter box 10 for which the identifier has already been input and possibly after acting in a prior step 120 to mark the franking authorization code 12A on the mailpiece, which code is communicated by the franking server and is needed for verifying the validity of this mailpiece.

At least once a day, at a known and predetermined instant, e.g. one hour after each collection of mail, the franking server 16 transfers to each of the mail-receiving office servers of the postal authority 20, and on the basis of the identifiers associated with each of those offices, all of the postal data relating to the payment operations that have been performed in association with each of them, or more simply giving each server right to access all of its data directly. It should be observed that this transfer operation from the franking server is not necessary when the identifier of the letter box includes the address of the mail-receiving office server from which it depends, since it will already have received its data, since the identifier extraction step 102 provides this address, and the step 108 of communicating the unique identification code is performed in parallel to the sever of the mail-receiving office corresponding to said address.

Thus, with the present invention, any sender can proceed very simply with sending an arbitrary mailpiece, a letter or a package, to any destination, without it being necessary to have access to an open office of the postal authority, since the received franking authorization code or the preprinted unique identification code (replacing the stamp or postal imprint of a postage meter, and performing its function although having no monetary value) marked on each mailpiece is sufficient to enable the mail-receiving office of the postal authority concerned to find the mailpiece and verify it.

When the mailpiece is put into one of the mail-receiving offices, the postal authority firstly reads the mailpiece optically in order to extract the franking authorization code or the unique identification that it carries and also its destination address, and more precisely the geographical zone of the destination (destination post code) of the mailpiece, and possibly also the service requested if preprinted on the mailpiece, e.g. "priority", and secondly, where necessary, it weighs the mailpiece to determine its weight category, and on the basis of that information, calculates the franking amount required for the mailpiece. All that then remains to be done in order to authorize delivery of the mailpiece to its destination is merely to verify that the amount paid by the sender and stored in the server 20 is at least equal to the franking amount as calculated. When payment is not sufficient, the postal authority calculates the extra payment that needs to be paid by the addressee in order to receive the mailpiece.

What is claimed is:

1. A method of franking a mailpiece that is to be put into a letter box associated with a mail-receiving office, comprising the following steps:

inputting into a portable communications device of a sender of the mailpiece, an identifier of said letter box, and transmitting by the portable communications device the identifier together with other postal data, further including at least one franking amount and an unique identification code relating to the mailpiece, to a server of a franking service having a function of issuing a franking authorization for the sender.

2. A method according to claim 1, wherein said unique identification code is applied on the mailpiece or generated in the portable communication device.

3. A method according to claim 1, wherein said operation of inputting the identifier of said letter box comprises manual input via the keypad of said portable communications device.

4. A method according to claim 1, wherein said operation of inputting the identifier of said letter box comprises optically reading said identifier by digital pickup means of said portable communications device.

5. A method according to claim 4, wherein said operation of optically reading the identifier further includes extracting from said identifier an electronic address of said mail-receiving office to which said letter box is attached.

6. A method according to claim 5, further comprising a step of, from said portable communications device, transferring to said electronic address a fraction of the postal data corresponding to the mailpiece placed in said letter box.

7. A method according to claim 1, further comprising an operation of said server of the franking service of transferring a fraction of the postal data corresponding to the mailpieces placed in said letter box to a server of said mail-receiving office to which said letter box is attached.

8. A method according to claim 7, wherein said transfer operation is performed at a predetermined periodicity corresponding to the times mail is collected from said letter box.

9. A portable communications device that implements the franking of a mailpiece deposited in a letter box associated with a mail-receiving office, the device comprising:

an input mechanism into which an identifier of said letter box is input, and a transmitting mechanism that transmits the identifier together with other postal data including at least one franking amount and a unique identification code relating to the mailpiece, to a server of a franking service that issues a franking authorization.

10. A device according to claim 9, constituting by one of the following devices: a cell phone; a communicating personal digital assistant; a communicating laptop computer.

11. A non-transitory computer-readable medium having stored thereon a program causing a computer to execute a franking method for a mailpiece deposited into a letter box associated with a mail-receiving office, comprising:

inputting into a portable communications device of a sender of the mailpiece, an identifier of said letter box, and transmitting by the portable communications device the identifier together with other postal data, further including at least one franking amount and an unique identification code relating to the mailpiece, to a server of a franking service having a function of issuing a franking authorization for the sender.

* * * * *